US009402464B2

(12) United States Patent
Beermeunder et al.

(10) Patent No.: US 9,402,464 B2
(45) Date of Patent: Aug. 2, 2016

(54) PAINT BRUSH ADAPTER TOOL

(71) Applicant: NEXT FUTURE LLC, Dublin, OH (US)

(72) Inventors: Michael Beermeunder, Clinton, CT (US); Ellen M. Brown, Columbus, OH (US); James L. Kennedy, Dublin, OH (US); Charles R. Patzer, Columbus, OH (US)

(73) Assignee: NEXT FUTURE LLC, Dublin, OH (US)

( * ) Notice: Subject to any disclaimer, the term of this patent is extended or adjusted under 35 U.S.C. 154(b) by 173 days.

(21) Appl. No.: 14/261,969

(22) Filed: Apr. 25, 2014

(65) Prior Publication Data

US 2014/0317863 A1 Oct. 30, 2014

Related U.S. Application Data

(60) Provisional application No. 61/816,074, filed on Apr. 25, 2013.

(51) Int. Cl.

| | |
|---|---|
| ***A46B 15/00*** | (2006.01) |
| ***B25F 1/00*** | (2006.01) |
| ***A46B 17/02*** | (2006.01) |

(52) U.S. Cl.

CPC ..... *A46B 15/0063* (2013.01); *A46B 15/0055* (2013.01); *A46B 15/0081* (2013.01); *A46B 17/02* (2013.01); *B25F 1/00* (2013.01); *A46B 2200/202* (2013.01); *Y10T 29/49948* (2015.01)

(58) Field of Classification Search

CPC ..... B25F 1/00; B25F 1/006; B25F 1/02; B25F 1/04; A46B 15/0055; A46B 15/0063; A46B 15/0081; A46B 15/0083; A46B 2200/202

USPC ..... 15/105, 111, 144.1, 172, 236.01, 15/236.05; 7/105, 151, 165, 166, 168; 30/340, 342, 344

See application file for complete search history.

(56) References Cited

U.S. PATENT DOCUMENTS

| | | | | |
|---|---|---|---|---|
| 122,186 | A | 12/1871 | Michaels | |
| 1,421,478 | A | 7/1922 | Hope | |
| 1,430,441 | A * | 9/1922 | Forsberg | A46B 15/00 15/111 |
| D117,933 | S | 4/1939 | Manchester | |
| 2,533,838 | A | 9/1945 | Ranft | |
| 2,447,862 | A | 12/1946 | Kane | |
| 2,603,991 | A * | 7/1952 | Oliver | B67B 7/14 15/105 |

(Continued)

FOREIGN PATENT DOCUMENTS

WO 2008002994 1/2008

OTHER PUBLICATIONS

Blade Brush—Paint Brush Tools—www.bladebrush.com/index.html, printed Dec. 13, 2012.

*Primary Examiner* — Mark Spisich

(74) *Attorney, Agent, or Firm* — Vorys, Sater, Seymour and Pease LLP; Rex W. Miller, II

(57) ABSTRACT

Described in this application is a kit for adapting a paint brush having a handle opening. The kit includes a tool for improving the usefulness of the paint brush; a bushing receivable within the handle opening of the paint brush; a screw for passing through the tool and bushing and joining the tool to the paint brush; and a locking nut for securing the screw to the paint brush.

15 Claims, 6 Drawing Sheets

(56) References Cited

U.S. PATENT DOCUMENTS

| | | | | | |
|---|---|---|---|---|---|
| 2,669,084 | A * | 2/1954 | Warren | A01D 34/736 | 30/347 |
| 3,355,200 | A * | 11/1967 | Storch | B26B 13/28 | 30/267 |
| 3,984,892 | A * | 10/1976 | Kyriakou | A46B 17/02 | 15/111 |
| 4,041,564 | A | 8/1977 | Schlincher | | |
| 4,590,637 | A | 5/1986 | Marino | | |
| 4,727,618 | A | 3/1988 | Mahoney | | |
| 4,741,064 | A | 5/1988 | Riegert | | |
| 4,916,773 | A | 4/1990 | McCoy | | |
| 5,419,000 | A | 5/1995 | Amato | | |
| D366,150 | S | 1/1996 | Suchomel | | |
| 5,493,783 | A * | 2/1996 | Oostendorp | A01D 75/206 | 30/276 |
| 5,842,488 | A * | 12/1998 | Belleau | A45D 34/04 | 132/320 |
| 5,857,234 | A | 1/1999 | Hernnandez | | |
| 5,894,624 | A | 4/1999 | Fulenwider | | |
| D416,390 | S | 11/1999 | Corriveau | | |
| 6,012,865 | A * | 1/2000 | Scott | B05C 17/022 | 15/144.1 |
| D423,788 | S | 5/2000 | Southwell | | |
| D461,960 | S | 8/2002 | Bock | | |
| D474,342 | S | 5/2003 | Silvestri | | |
| 6,823,553 | B1 | 11/2004 | Paredes | | |
| D634,549 | S | 3/2011 | Arvinte | | |
| 2008/0092314 | A1 | 4/2008 | Griffin | | |
| 2014/0338500 | A1 * | 11/2014 | Cridlebaugh | B67B 7/12 | 81/3.27 |

* cited by examiner

PAINT BRUSH ADAPTER TOOL

The present application claims priority to U.S. Provisional Application No. 61/816,074 filed Apr. 25, 2013, the contents of which are hereby incorporated in their entirety.

BACKGROUND

The present invention relates to a method and apparatus for adapting a paint brush to include a tool. More specifically, the present invention relates to a method and apparatus for modifying different types of paint brushes to include a tool.

In the painting industry it is often necessary for painters who are using a brush to require additional tools, such as a screwdriver to remove face plates or a paint can opener to open a can of paint. If the painter is on a ladder, the painter must store his brush, climb down the ladder, then locate the tools appropriate for the job before returning.

There is therefore recognized a need in the art to improve a paint brush by allowing for the attachment of one or more tools to the paint brush to eliminate the need to carry extra tools.

Paint brushes are available in a variety of sizes and dimensions from various manufacturers. Despite differences in size, dimension and appearance of paint brushes, it is desirable to be able to mount one or more removable tools to the handle of the brush. Rather than provide differently sized tools for each and every brush, it is desirable, to reduce costs and material, to provide one removable tool assembly that may be adapted to multiple brush handles.

Therefore, there is recognized a need in the art for a removable tool that may be easily adapted to accommodate brushes having various sizes and/or shapes.

SUMMARY

Described in this application is a kit for adapting a paint brush having a handle opening. The kit includes a tool for improving the usefulness of the paint brush; a bushing receivable within the handle opening of the paint brush; a screw for passing through the tool and bushing and joining the tool to the paint brush; and a locking nut for securing the screw to the paint brush.

The tool of the kit may include a first end and a second end, the first end may be a screwdriver and the second end may be a paint can opener.

The tool and bushing may also include retaining portions for preventing slippage of the tool.

The locking nut may include one or more barbs for engaging the handle of the brush.

Also disclosed in this application is a paint brush that includes a handle having a through hole; a plurality of bristles; and a tool assembly comprising. The tool assembly includes a screw having a length corresponding to a thickness of said through hole; a tool; a bushing having a diameter corresponding to a diameter of said through hole; and a locking nut for engaging the handle and preventing rotation of the locking nut; wherein the screw engages said locking nut and secures said tool and bushing to said handle.

The tool may include a first end and a second end; the first end may be a paint can opener and the second end may be a screw driver.

The tool may be rotatable relative to the handle, thereby enabling use of one or the other of the can opener and screw driver.

The tool and bushing may include interlocking structure for preventing inadvertent rotation of the tool relative to the handle.

The tool may be removably attached to the handle, allowing the tool to be easily removed without damage or extensive modification of the brush or handle.

Also disclosed is a method of attaching a tool assembly to a paint brush. The method includes the steps of providing a paint brush having a handle with a through hole; providing a tool assembly comprising a plurality of screws, at least one tool, a plurality of bushings, and at least one locking nut; selecting a bushing having a diameter approximately equal to a diameter of said through hole; selecting a screw having a length approximately equal to a width of said handle; inserting said bushing into said through hole; inserting said screw through said tool and said bushing; and securing said locking nut to said screw, thereby securing said tool to said handle.

The tool may include a first end and a second end; the first end being a screwdriver and the second end being a paint can opener. The tool may be rotatable relative to the handle and include structure for engaging the bushing and preventing inadvertent rotation of the tool during use.

DETAILED DESCRIPTION

Figure 1:
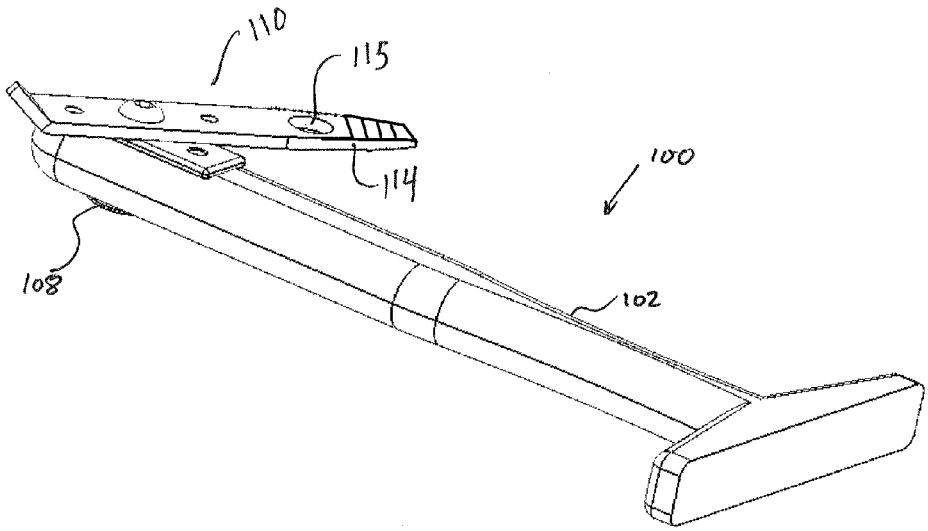
FIG. 1 is a perspective view of a paint brush with the tool assembly.

As illustrated in FIG. 1, a paint brush 100 is provided. The paint brush 100 includes a handle 102 and bristles connected by a ferrule. The handle 102 includes a through hole or opening 108 passing through the handle 102. A brush adapter tool 110 has been provided in the through hole 108. The brush adapter tool 110 is provided to increase the utility of the paint brush 100.

Figure 2:
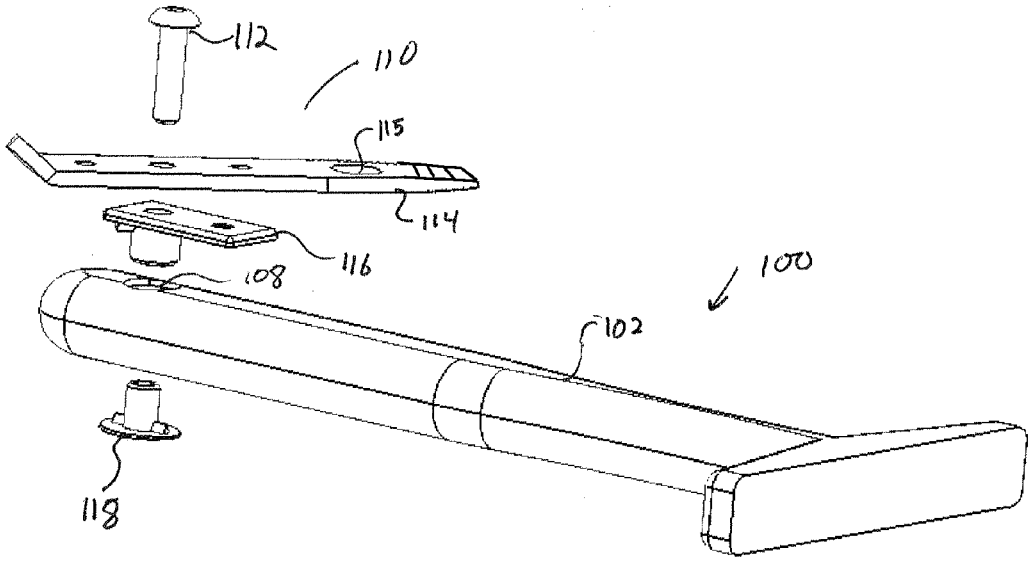
FIG. 2 is a perspective view of the paint brush with the tool assembly.

FIG. 2 is a perspective exploded view of the paint brush 100 and brush adapter tool 110. As illustrated, the brush adapter tool 110 includes a screw 112, tool 114, bushing 116 and locking nut 118. The brush adapter tool 110 is attached to the handle 102 of the brush 100 by the screw 112 and lock nut 118. The tool 114 is rotatable about the screw 112 to provide two alternative working ends.

Figure 3:
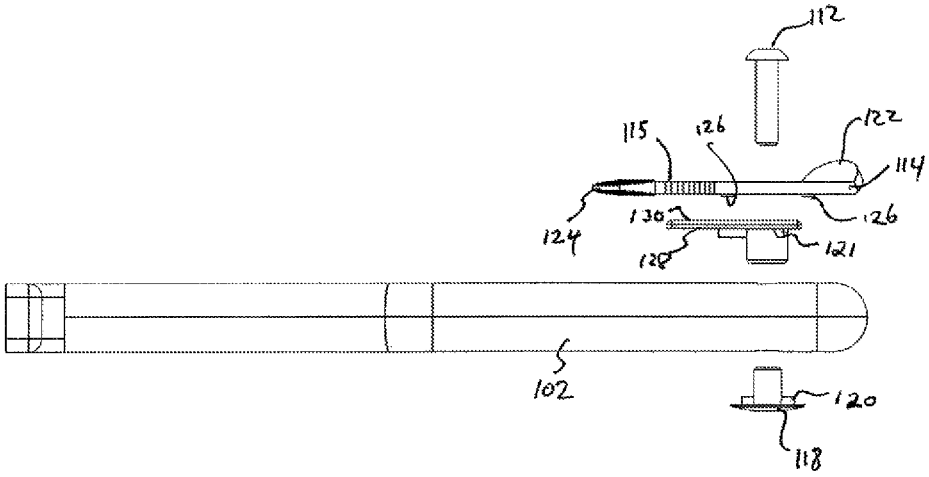
FIG. 3 is an exploded side view of the paint brush with the tool assembly.

FIG. 3 is a side plan exploded view of the paint brush 100 and brush adapter tool 110 illustrated in FIG. 2. The tool 114 and bushing are illustrated in further detail in this figure.

According to the illustrated embodiment, the tool 114 includes a first end 122 and a second end 124 that may have different tools. In this embodiment, the first end 122 of the tool 114 is a paint can opener that is useful for opening paint cans or the like. The second end 124 of the tool is a screwdriver, such as a flat-head screwdriver, that may be useful for removing face plates or the like. In embodiments, the flat-head screwdriver has a width greater than the dimension of a standard electrical outlet in order to prevent a user from inadvertently inserting the screwdriver into an outlet while removing or installing outlet face plates. The tool 114 may also include an opening 115 for hanging the tool on a hook for display or storage. Normally, the paint brush 100 is stored on a hook by the through hole 108, but because this adapter tool 110 replaces the through hole 108, another opening 115 is provided. While these are two options for the tool 114, it will be appreciated that other tools may also be used. Further, while the tool 114 is described as having two different tools, it will be apparent that the tool may have multiple tools, a single tool, or an adapter for receiving various tools as replacement parts.

As further illustrated in FIG. 3, the tool 114 may include one or more locking protrusions 126 that extend away from the tool. These locking protrusions 126 may be circular and correspond to one or more dimples 128 in the arm 130 of the bushing 116. When the tool 114 is rotated about the screw 112, one or the other locking protrusions 126 will align with the dimple 128 and prevent the tool 114 from inadvertently turning. This improvement prevents the tool 114 slipping or twisting unexpectedly.

FIG. 3 also illustrates the bushing 116 in further detail. In the illustrated embodiment, the bushing 116 is sized to be received within the paint brush through hole 108 and includes an arm 130 extending along the brush handle 102. The arm 130 includes the dimple 128 for receiving the locking protrusions 126 of the tool 114. As further illustrated, the bushing 116 may include axial protrusions 121 for engaging the sides of the hole 108 to prevent accidental rotation of the bushing 116.

Finally, FIG. 3 illustrates the locking nut 118 of the brush adapter tool 110. In the illustrated embodiment, the locking nut 118 includes barbs 120 that bite into the brush handle 102. These barbs may be especially useful for a brush having a wooden handle. However, it is contemplated that other types of locking nuts may also be used, and will be appreciated by those having skill in the art.

Figure 4:
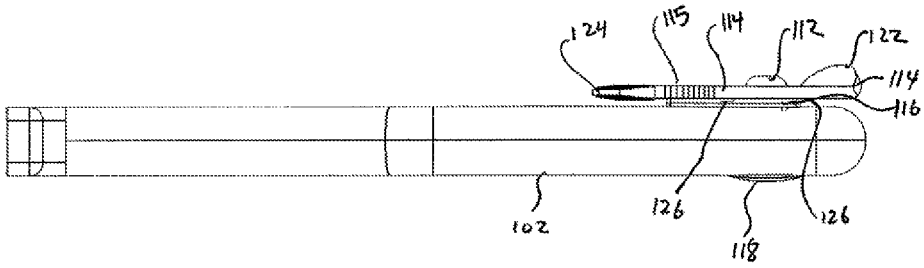
FIG. 4 is a side view of the paint brush with the tool assembly.

The brush adapter tool 110 is shown in a side plan view in FIG. 4 assembled to the brush handle 102. In this view, it will be apparent that the locking protrusion 126 of the tool 114 engages the dimple 128 of the bushing 116 to thereby secure the first end 122 of the tool 114 in position. Further, when the screw 112 is inserted into the lock nut 118, the barbs 120 of the lock nut 118 will engage the handle 102 and prevent rotation of the brush adapter tool 110.

According to the preferred embodiment of the invention, the screw 112, tool 114 and bushing 116 are formed of a durable plastic material that is inexpensive and easily assembled. The locking nut 118 may be an off-the-shelf metal part, or may be assembled of the same plastic of the screw 112. However, it is further contemplated that the various components of the brush adapter tool 110 may be formed of different materials, including metal, carbon fiber, or other material suitable for the purpose. For example, the tool 114 may be replaced with a stamped metal piece, adding rigidity and durability and the screw 112 and bushing 116 may be inexpensive molded plastic.

Another aspect of the invention is a kit for adapting a brush to include a multi-purpose tool. The kit includes a screw 112, tool 114, bushing 116 and locking nut 118. The bushing is designed to be inserted into a through hole 108 of a paint brush handle 102. The tool 114 is placed on the bushing 116 and the pieces secured to the brush handle 102 by means of the screw 112 and locking nut 118. The tool 114 may be provided with a first end 122 and a second end 124 so that either tool may be alternatively selected. A locking protrusion 126 may be provided to hold the tool 114 in place and prevent accidental rotation of the tool when one of the first 122 or second 124 ends is selected.

According to another aspect of the invention, the kit may include one or more bushings 116 of varying diameters that are designed to engage different sized through holes 108 of brush handles 102. The kit may also include one or more screws 112 of varying lengths that are designed to engage different widths of the brush handle 102. It is anticipated that the bushings 116 and screws 112 are selected to be interchangeable without noticeably altering the primary function of the claimed invention.

Also disclosed in this application is a method of adapting a paint brush 100 to include multiple tools. According to this method, a brush adapter tool 110 is provided that includes a plurality of screws 112, a tool 114, a plurality of bushings 116 and a locking nut 118. The paint brush 100 is provided with a brush handle 102 that includes a through hole 108 passing through the width.

A bushing 116 is selected that corresponds to the approximate diameter of the through hole 108. The bushing 116 is inserted into the through hole 108 and positioned so that an arm 130 of the bushing extends along the handle 102.

Next, a screw 112 is selected having a length approximately equal to the width of the brush handle 102. The tool 114 is positioned on the bushing 116 and the screw 112 is inserted through the tool 114 and bushing 116.

Finally, a locking nut 118 is threaded onto the end of the screw 112 from the opposite end of the brush handle 102. As the locking nut 118 is secured onto the screw 112, the locking nut will engage the brush handle 102, thereby securing the locking nut to the handle and preventing rotation of the assembly 110.

In other embodiments, the screw 112 may have a length greater than the width of the brush handle 102, and the excess length of the screw 112 protruding from the locking nut 118 may be clipped or trimmed.

Figure 5:
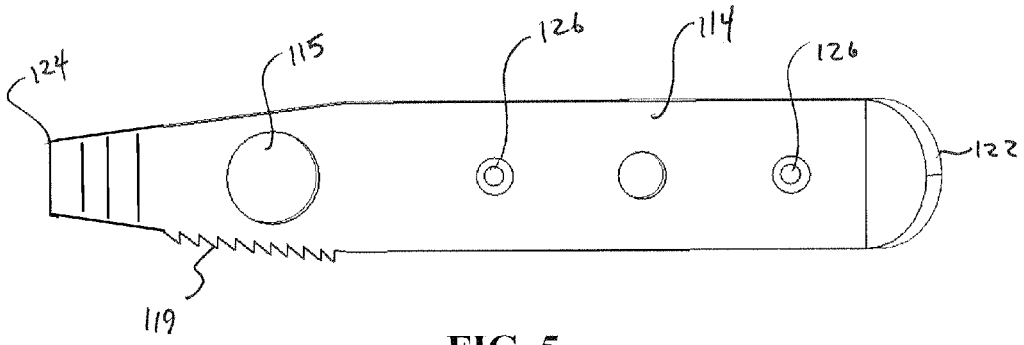
FIG. 5 is a top view of the tool attachment for the brush buddy.

In other embodiments, additional elements may be added to the tool 114. In one embodiment, illustrated in FIG. 5, the tool 114 includes serrations 119 along the edge and/or face of the blade for scraping.

Figure 6:
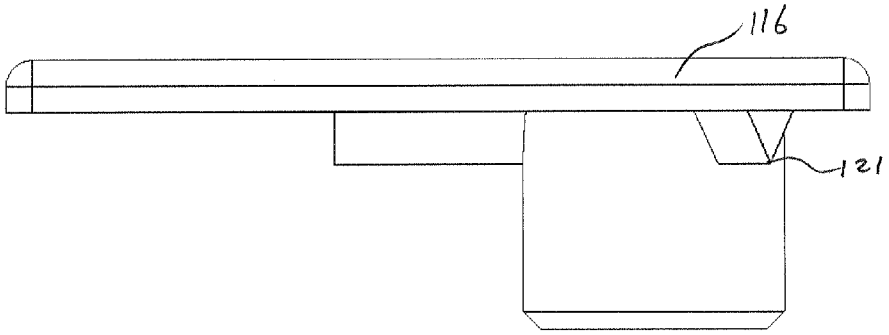
FIG. 6 is a side view of the bushing for attaching the tool to the brush.

The bushing 116 may also include a wedge detail 121, as shown in FIG. 6, that makes contact with the brush handle and embeds into the wood. This detail is effective in keeping the components from rotating during and after assembly.

Figure 7:
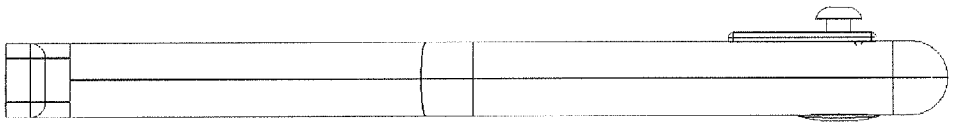
FIG. 7 is a side view of the brush with bushing attached.

FIG. 7 is a side plan view showing the bushing and lock nut attached to the handle of a brush, the bushing and lock nut secured thereto by the screw.

Figure 8:
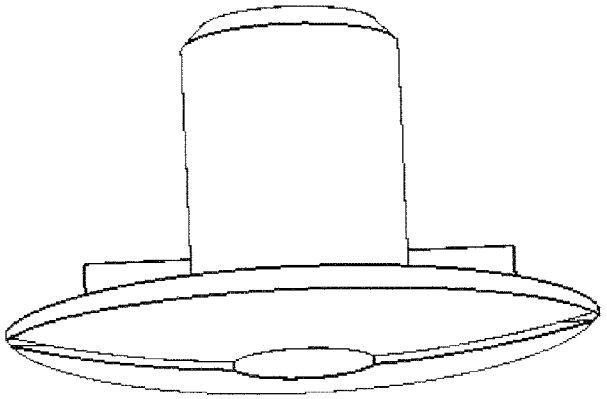
FIG. 8 is a side elevation view of the locking nut for attaching the bushing to the brush.

FIG. 8 is an elevated side view of the lock nut. The lock nut includes protrusions for engaging and securing the nut to the handle of the brush, preventing the screw from turning.

Figure 9:
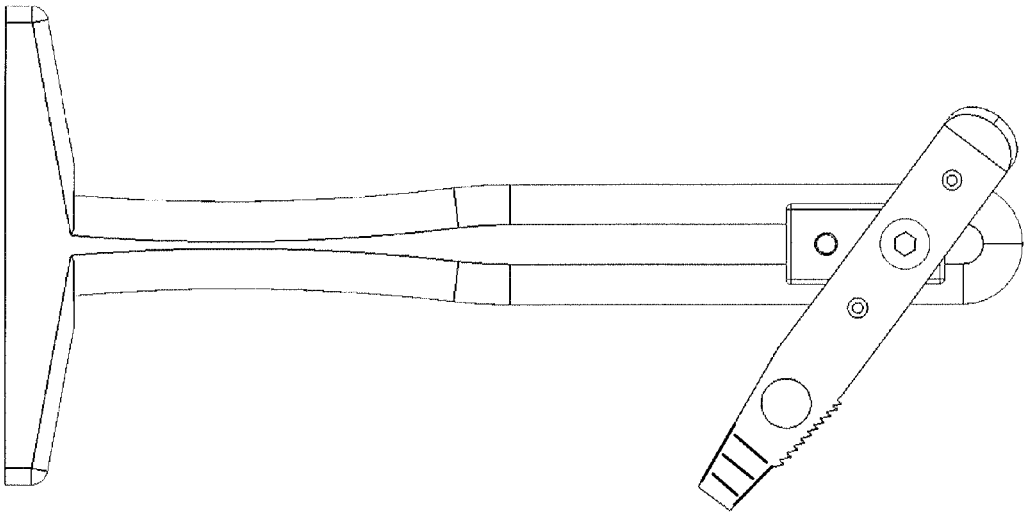
FIG. 9 is a top plan view showing the tool attached to the brush.

FIG. 9 is a top plan view of the brush buddy attached to a brush. As shown in this figure, the tool is in an intermediate position. In this intermediate position, the tool may be freely rotated about the screw.

Figure 10:
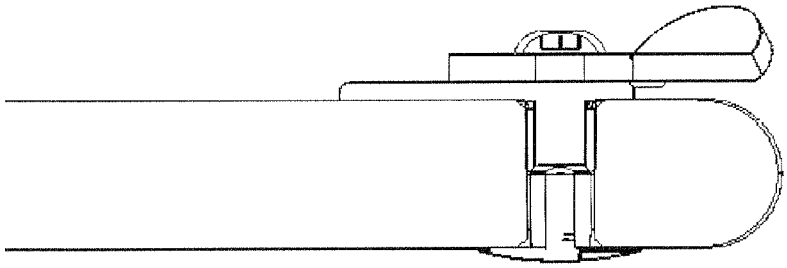
FIG. 10 is a side cutaway view showing the assembled brush buddy.

FIG. 10 is a side cutaway view showing the brush buddy engaging the handle of the brush through an opening on one end of the handle. The bushing enters one side of the opening and the lock nut enters the opposite side. A screw secures tool to the bushing, passes through the opening, and is secured to the lock nut.

Figure 11:
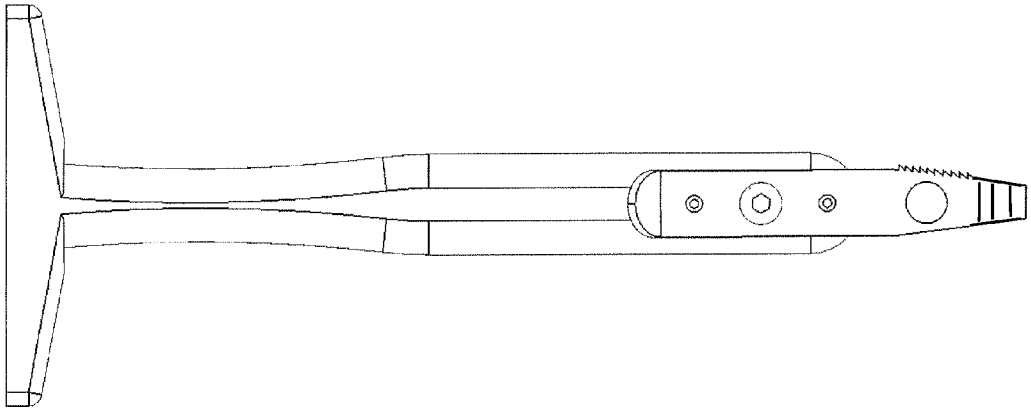
FIG. 11 is a top plan view showing the tool in a first operating orientation.

FIG. 11 shows the brush buddy with the tool in a first orientation. In this orientation, the first tool, such as the illustrated screwdriver, can be used.

Figure 12:
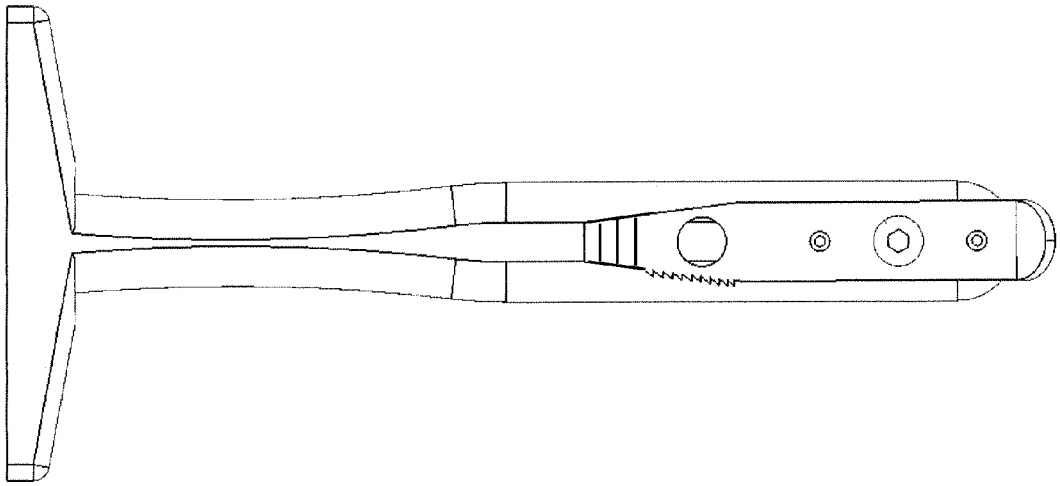
FIG. 12 is a top plan view showing the tool in a second operating orientation.

FIG. 12 shows the brush buddy with the tool in a second orientation. In this orientation, the second tool, such as a paint can opener, can be used.

The various arrangements and embodiments discussed above are meant to be illustrative and not limiting of the disclosed invention. Any limitations to the scope of the invention will appear in the claims as allowed.

What is claimed is:

1. A kit for adapting a paint brush having a handle opening, the kit comprising:

a tool for improving the usefulness of the paint brush, the tool having a first end comprising a paint can opener and a second end comprising a screw driver, wherein the screw driver is defined by a portion of the second end with a tapered width and a tapered thickness;

a bushing receivable within the handle opening of the paint brush;

a screw for passing through the tool and bushing and joining the tool to the paint brush; and a locking nut for securing the screw to the paint brush such that the tool is rotatable relative to the handle.

2. The kit for adapting a paint brush as described in claim 1 wherein the tool and bushing include retaining portions for preventing the tool from slipping.

3. The kit for adapting a paint brush as described in claim 2 wherein the locking nut includes one or more barbs for engaging the brush handle.

4. A paint brush comprising:

a handle having a through hole;

a plurality of bristles; and a tool assembly comprising:

a screw having a length corresponding to a thickness of said through hole;

a tool that is rotatable relative to the handle, the tool having a first end comprising a paint can opener and a second end comprising a screw driver, wherein the screw driver is defined by a portion of the second end with a tapered width and a tapered thickness;

a bushing having a diameter corresponding to a diameter of said through hole, the bushing further having an arm that extends along the handle between the handle and the tool; and a locking nut for engaging the handle and preventing rotation of the locking nut;

wherein the screw passes through the tool and the bushing and engages said locking nut to secure said tool and bushing to said handle such that the tool is rotatable relative to the handle.

5. The paint brush of claim 4 wherein the tool and bushing include interlocking structure for preventing inadvertent rotation of the tool relative to the handle.

6. The paint brush of claim 5 wherein the tool is removably attached to said handle.

7. The paint brush of claim 5, wherein the tool has one or more protrusions and the arm of the bushing has one or more dimples configured to receive the one or more protrusions to prevent the tool from inadvertently rotating during use.

8. The paint brush of claim 5, wherein the tool further comprises an opening configured for hanging the paintbrush by the tool on a hook.

9. The paint brush of claim 5, wherein the tool further comprises serrations along the second end of the tool.

10. A method of attaching a tool assembly to a paint brush, the method comprising the steps of:

providing a paint brush having a handle with a through hole;

providing a tool assembly comprising a plurality of screws, at least one tool, a plurality of bushings, and at least one locking nut; wherein the tool has a first end comprising a paint can opener and a second end comprising a screw driver, wherein the screw driver is defined by a portion of the second end with a tapered width and a tapered thickness;

selecting a bushing having a diameter approximately equal to a diameter of said through hole;

selecting a screw having a length approximately equal to a width of said handle;

inserting said bushing into said through hole such that an arm of the bushing extends along the handle between the handle and the tool and an axial protrusion of the bushing engages a side of the through hole to prevent rotation of the bushing relative to the handle;

inserting said screw through said tool and said bushing; and securing said locking nut to said screw, thereby securing said tool to said handle, such that the tool is rotatable relative to the handle.

11. The method of claim 10 wherein the tool and bushing include structure for locking said tool to prevent inadvertent rotation of said tool.

12. The method of claim 11 wherein the nut includes barbs for engaging the handle of said brush.

13. The method of claim 11, wherein the tool has one or more protrusions and the arm of the bushing has one or more dimples, and the method further includes engaging the one or more protrusions in the one or more dimples to prevent the tool from inadvertently rotating during use.

14. The method of claim 11, wherein the tool further comprises an opening configured for hanging the paintbrush by the tool on a hook.

15. The method of claim 11, wherein the tool further comprises serrations along the second end of the tool.

* * * * *